US005510962A

United States Patent [19]

Hsiao

[11] Patent Number: 5,510,962

[45] Date of Patent: Apr. 23, 1996

[54] SCREWDRIVER WITH AN ILLUMINATOR

[76] Inventor: Hsuan-Sen Hsiao, No. 20, Alley 235, Fu-Shang Lane, Taichung, Taiwan

[21] Appl. No.: 402,524

[22] Filed: Mar. 10, 1995

[51] Int. Cl.[6] ..... B25B 23/18

[52] U.S. Cl. ..... 362/120; 362/196

[58] Field of Search ..... 362/109, 119, 362/120, 189, 191, 196

[56] References Cited

U.S. PATENT DOCUMENTS 4,107,765 8/1978 Singleton et al. ..... 362/120

5,051,876 9/1991 Norman ..... 362/120

*Primary Examiner*—Stephen F. Husar

*Attorney, Agent, or Firm*—Bacon & Thomas

[57] ABSTRACT

A screwdriver having a lamp holder mounted at one end of the handle around the driving shank, and a lamp and battery assembly mounted within a recessed hole on the lamp holder, wherein the lamp is turned on to give off light when the lamp and battery assembly is depressed, or turned off when the lamp and battery assembly is released from the hand.

4 Claims, 5 Drawing Sheets

SCREWDRIVER WITH AN ILLUMINATOR

BACKGROUND OF THE INVENTION

The present invention relates to screwdrivers, and relates more particularly to such a screwdriver which has a lamp assembly disposed adjacent to the driving shank and depressed to give off light for illuminating the workpiece.

Various fixed type as well as reversible screwdrivers have been developed, and have appeared on the market. When a screwdriver is used to turn a screw in a narrow, dark place, one shall have to hold a separate illuminator for illumination so that the operation can proceed. However, it is inconvenient to turn a screw by a screwdriver when one holds an illuminator in hand. FIG. 1 shows a screwdriver with an illuminator designed to eliminate this problem. This structure of screwdriver has a hollow handle covered with a transparent cap to hold a lamp assembly on the inside. The lamp assembly comprises a battery, a lamp bulb, and an ON/OFF switch. When the switch is switched on, the lamp bulb is turned on to give off light. This structure of screwdriver with an illuminator is complicated and expensive, and the mechanical ON/OFF switch tends to be damaged.

SUMMARY OF THE INVENTION

The present invention provides a screwdriver with an illuminator which comprises a handle, a driving shank connected to the handle and controlled by a switch for holding down a workpiece or for turning it forwards or backwards, a lamp holder mounted at one end of the handle around the driving shank, and a lamp and battery assembly mounted within a recessed hole on the lamp holder, wherein the lamp is turned on to give off light when the lamp and battery assembly is depressed, or turned off when the amp and battery assembly is released from the hand,

DETAILED DESCRIPTION OF THE PREFERRED EMBODIMENT

Figure 1:
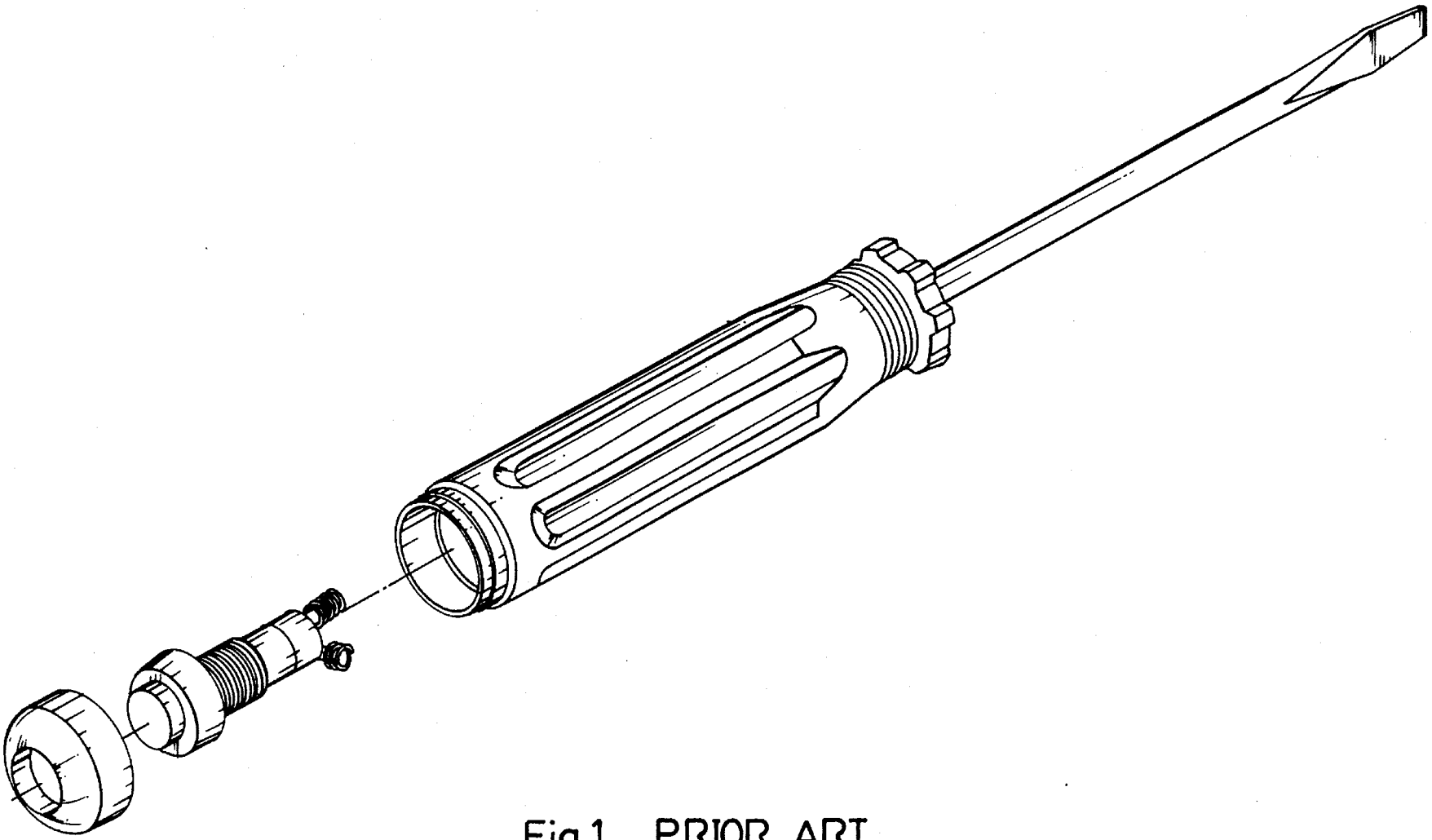
Fig.1 PRIOR ART
FIG. 1 is a perspective view of a screwdriver with an illuminator according to the prior art.
Figure 2:
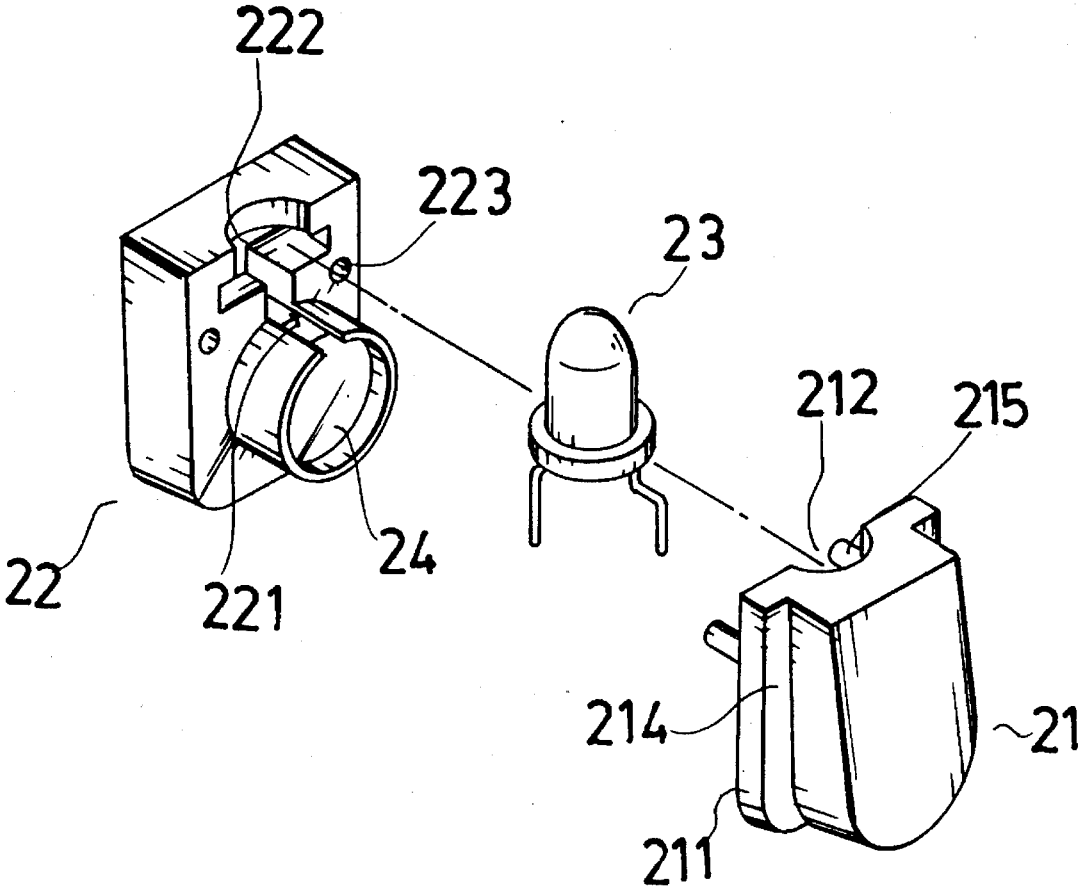
FIG. 2 is an exploded perspective view of a lamp assembly according to the present invention.
Figure 3:
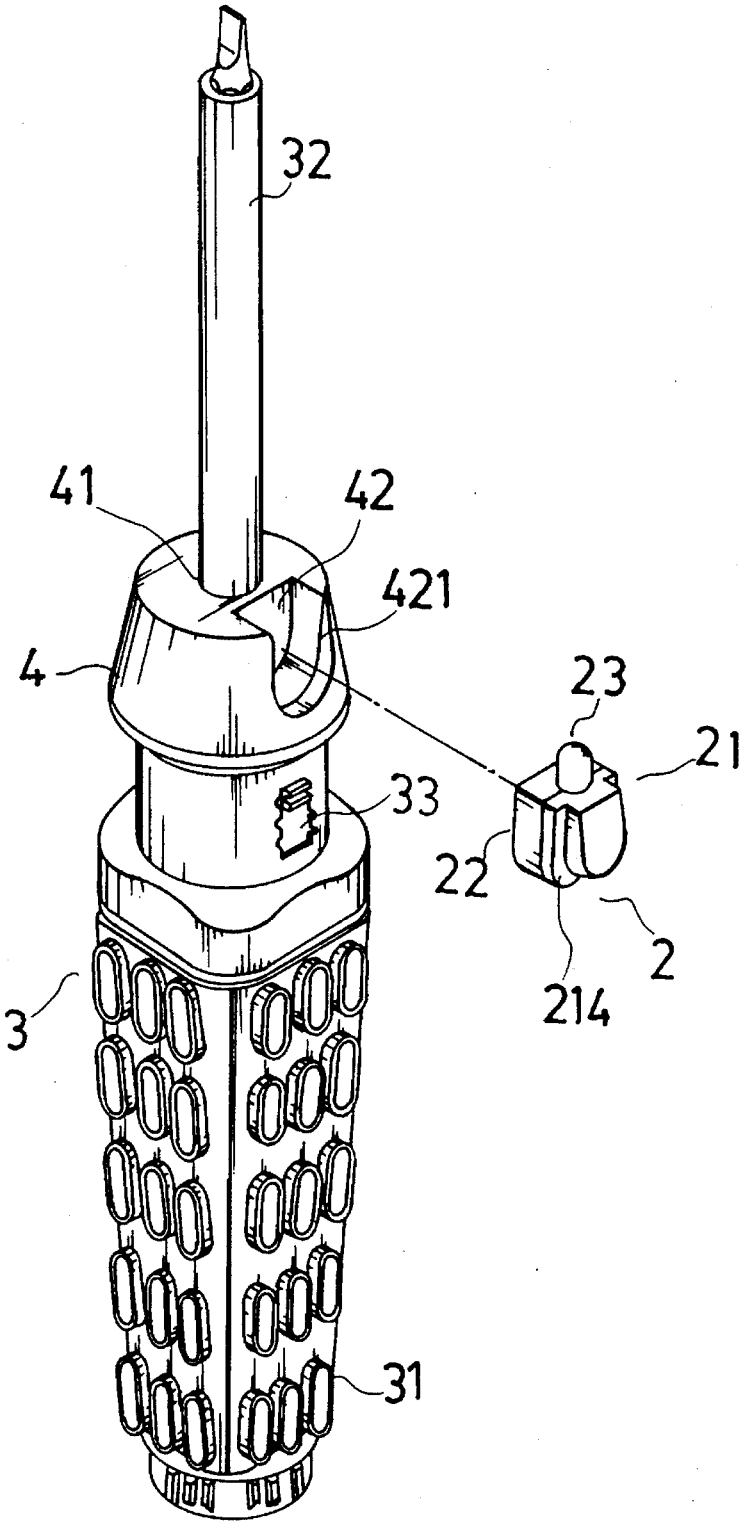
FIG. 3 is an exploded perspective view of a screwdriver with an illuminator according to the present invention.
Figure 4:
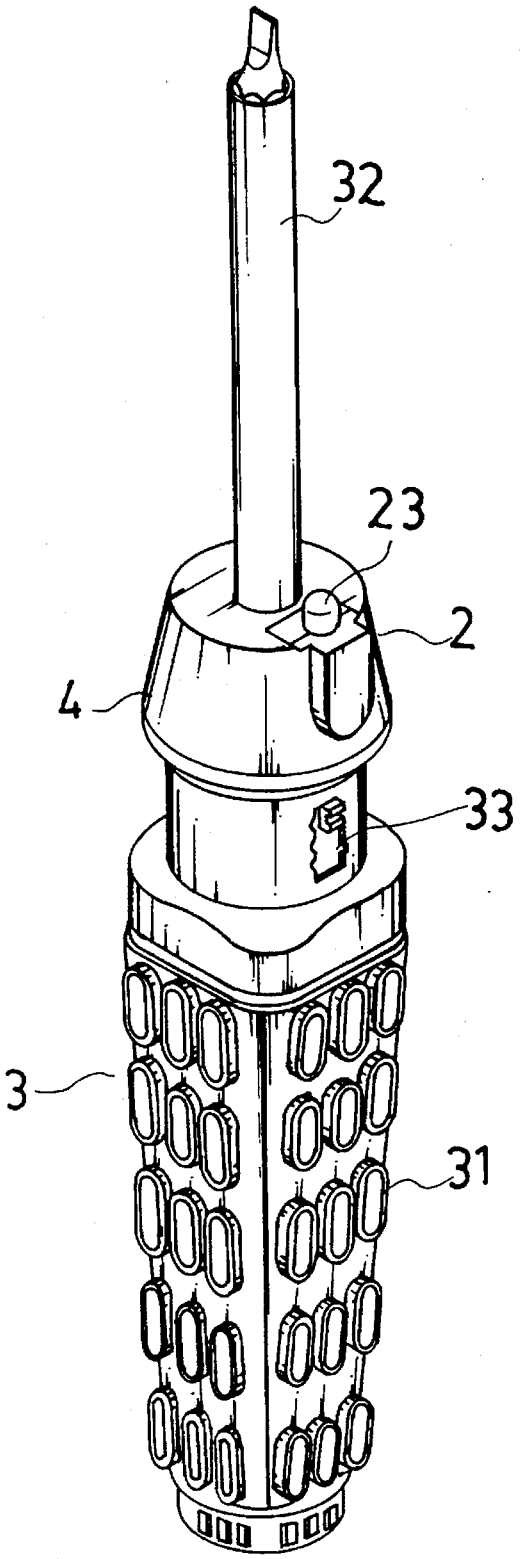
FIG. 4 is an assembled perspective view of the screwdriver shown in FIG. 3.

Referring to FIGS. 2 and 3, the screwdriver, referenced by 3, has a lamp holder 4 fixedly connected to one end of the handle 31 thereof to hold a lamp assembly 2 in a recessed hole 42 on the lamp holder 4. The lamp holder 4 has a flange 421 around the border of the recessed hole 42, and a center through hole 41, which receives the shank, referenced by 32. A switch 33 is mounted on the handle 31 of the screwdriver 3 and longitudinally aligned with the recessed hole 42 and moved to control the forward/backward driving operation of the screwdriver 3. The lamp assembly 2 comprises a base 22, a cover 21, and a LED (light emitting diode) 23. The cover 21 and the base 22 are molded from flexible plastics. The cover 21 comprises a peripheral flange 214, a recess 211 and a T-groove 212 connected together at a back side thereof, and two symmetrical upright pins 215 extending outwardly from the back side. The base 22 comprises a battery holder 221 fitted into the recess 211 on the cover 21 to hold a battery 24, a T-groove 222 corresponding to the T-groove 212 on the cover 21, two symmetrical pin holes 223, which receives the upright pins 215 of the cover 21. When the base 22 and the cover 21 are connected together by fitting the upright pins 215 into the pin holes 223, the two contact legs of the LED 23 are respectively retained in the T-grooves 212 and 222 and disposed adjacent to the two opposite terminals of the battery 24. When the lamp assembly 2 is assembled, it is fastened to the recessed hole 42 on the lamp holder 4 by engaging the flange 421 on the lamp holder 4 with the flange 214 on the cover 2.

Figure 5:
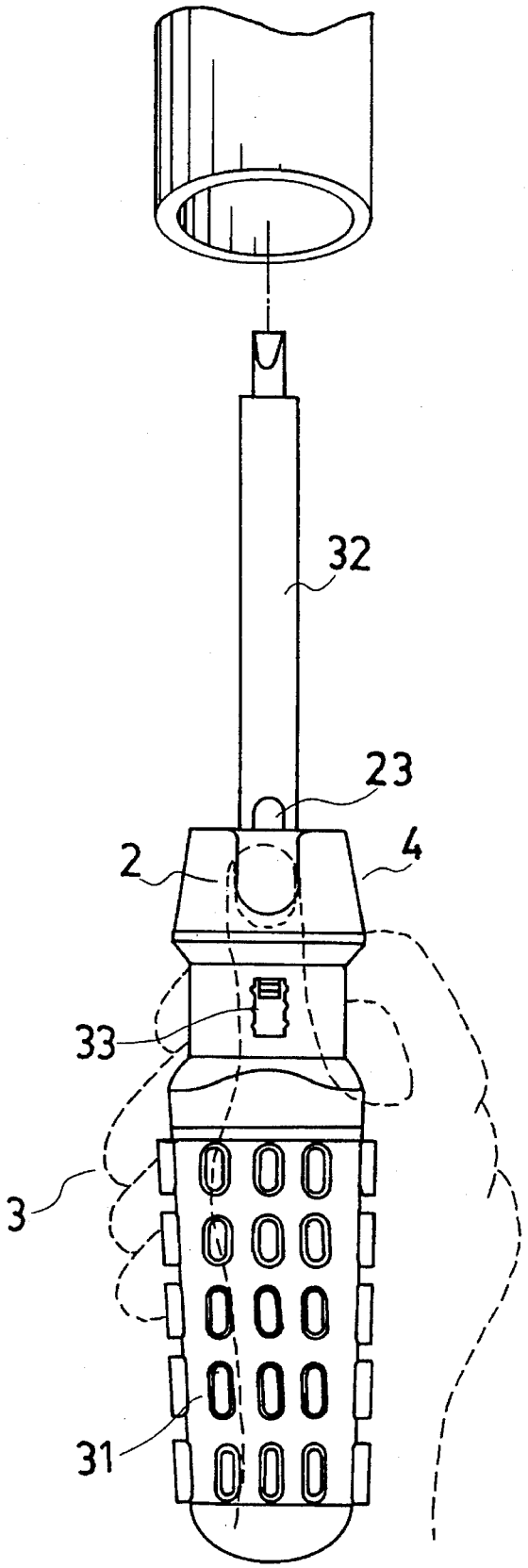
FIG. 5 is an applied view of the present invention.

Referring to FIG. 5, when the user holds the handle 31 of the screwdriver 3 in hand, the cover 21 of the tamp assembly 2 can be depressed by the thumb to force the two contact legs into contact position respectively connected to the two opposite terminals of the battery 24, and therefore the LED 23 is turned on to illuminate the workpiece.

I claim:

1. A screwdriver with an illuminator comprising:

a) a handle provided with a driving shank mounted thereon;

b) a lamp holder at an end of the handle adjacent the driving shank, the lamp holder including a recessed hole and a flange extending around a border of the recessed hole;

c) a lamp assembly disposed within the recessed hole, the lamp assembly including a base provided with a battery holder and a groove, a battery mounted within the battery holder of the base, a cover engaged with the base and provided with a recess and a groove, the battery holder being received within the recess of the cover, and a light source disposed between the base and the cover;

d) the light source including contact means for establishing electrical contact with the battery to illuminate the light source when the cover is depressed by a user, the contact means being disposed within the grooves of the base and cover; and e) the cover including a peripheral flange engaged with the flange extending around the border of the recessed hole.

2. The screwdriver of claim 1 wherein the grooves of the base and cover are each of a T-shaped configuration and the contact means of the light source includes a plurality of contact legs for contacting opposite terminals of the battery.

3. The screwdriver of claim 1 wherein the base includes a pair of pin holes formed therein, the cover includes a pair of pins extending outwardly from a backside thereof, and the pins being engaged within the pin holes.

4. The screwdriver of claim 1 wherein the base and cover are each molded from a flexible material.

* * * * *